US006183554B1

(12) United States Patent
Mizuta et al.

(10) Patent No.: US 6,183,554 B1
(45) Date of Patent: Feb. 6, 2001

(54) METHOD FOR PREPARING DENSE, EPITAXIAL METAL OXIDE FILM

(75) Inventors: Susumu Mizuta; Iwao Yamaguchi; Toshiya Kumagai; Takaaki Manabe, all of Tsukuba; Wakichi Kondo, Tsuchiura; Tadao Shimizu, Hino; Tsuyoshi Terayama, Kohnosu, all of (JP)

(73) Assignee: Director-General of Agency of Industrial Science and Technology (JP)

( * ) Notice: Under 35 U.S.C. 154(b), the term of this patent shall be extended for 0 days.

(21) Appl. No.: 09/272,564

(22) Filed: Mar. 19, 1999

(30) Foreign Application Priority Data

Oct. 13, 1998 (JP) ..... 10-290577

(51) Int. Cl.[7] ..... C30B 7/02

(52) U.S. Cl. ..... 117/68; 117/70; 117/944; 252/62.56

(58) Field of Search ..... 117/68, 70, 944; 252/62.56

(56) References Cited

U.S. PATENT DOCUMENTS 4,822,509 * 4/1989 Bishara et al. ..... 252/62.56
5,039,654 8/1991 Mizuta et al. ..... 505/1
5,071,830 12/1991 Olson et al. ..... 505/1

FOREIGN PATENT DOCUMENTS 0292967 5/1988 (EP) .
0508582 3/1992 (EP) .
2262107 3/1992 (GB) .
2264119 2/1993 (GB) .
05274668 * 10/1993 (JP) ..... 117/68

* cited by examiner

*Primary Examiner*—Robert Kunemund
(74) *Attorney, Agent, or Firm*—Lorusso & Loud

(57) ABSTRACT

A process for forming a dense, epitaxial metal oxide film on a single crystal substrate, including cleaning the surface of the single crystal substrate, contacting the cleaned surface with a polar organic compound such as a small molecular weight alcohol, so that the cleaned surface adsorbs the polar organic compound, then applying a hydrocarbon solvent solution containing at least one organic group-containing metal compound on the polar organic compound-adsorbed surface, and then heating the substrate to decompose the organic group-containing metal compound and to form a dense epitaxial metal oxide film on the substrate.

5 Claims, No Drawings

METHOD FOR PREPARING DENSE, EPITAXIAL METAL OXIDE FILM

BACKGROUND OF THE INVENTION

This invention relates to a process for preparing a dense, epitaxial metal oxide film.

U.S. Pat. No. 5,039,654 (Mizuta et al) discloses a method of preparing a superconductive material having a metal oxide superconductor layer provided on a substrate. The method includes dissolving a blend of organic group-containing metal compounds in an organic solvent, and applying the resulting solution on the substrate. The coating is then dried and calcined to form the metal oxide superconductor layer. The above method, which is simple and economical and can produce an oxide film having a uniform thickness, a uniform composition and a large size, has been also utilized for the formation of an epitaxial metal oxide film on a single crystal substrate.

The above method, however, has a problem because it is difficult to form a dense metal oxide film. Namely, during the calcination stage, the organic group contained in the raw material metal compounds is thermally decomposed to cause an abrupt, significant reduction of volume, so that pores are apt to be formed. Thus, in the case of production of an epitaxial oxide film on a single crystal substrate, even when a miss-fit of crystal lattice in the boundary between the substrate and the oxide film is small, a dense film is not easily obtained.

SUMMARY OF THE INVENTION

It is, therefore, the prime object of the present invention to provide a simple method which can produce a dense, epitaxial film on a single crystal substrate.

In accomplishing the above object, the present invention provides a process for preparing a dense, epitaxial metal oxide film, comprising the steps of:

cleaning a surface of a single crystal substrate;

contacting said cleaned surface with a polar organic compound so that said cleaned surface adsorbs said polar compound;

applying a hydrocarbon solvent solution containing at least one organic group-containing metal compound on said polar organic compound-adsorbed surface; and then heating said substrate to decompose said organic group-containing metal compound and to form a dense epitaxial metal oxide film on said substrate.

It has been unexpectedly found that when a hydrocarbon solvent solution containing at least one organic group-containing metal compound is applied on a surface to which a polar organic compound has been adsorbed and is then heated to decompose the metal compound, a dense metal oxide film grows eptiaxially.

Although not wishing to be bound by the theory, the organic group-containing metal compound applied on the polar compound-adsorbed surface of the substrate is probably regularly arranged and is oriented in one or more specific directions so that, upon calcination, metal oxide crystal lattices also orient regularly and are arranged densely. The polar organic molecules adsorbed on the substrate cause specific interaction between the organic group-containing metal molecules and the surface of the substrate and serve to enhance the specific adsorption of the organic group-containing metal molecules on the surface of the single crystal substrate.

Other objects, features and advantages of the invention will become apparent from the detailed description of the preferred embodiments of the invention to follow.

DETAILED DESCRIPTION OF THE PREFERRED EMBODIMENTS OF THE INVENTION

Any single crystal substrate may be used for the purpose of the present invention. Illustrative of suitable substrates are $Al_2O_3$, $SrTiO_3$, $LaAlO_3$ and MgO.

A surface of the substrate on which a metal oxide film is to be formed is cleaned of any dirt. Thus, the surface is preferably subjected to ultrasonic cleaning in an aqueous solution containing a surfactant, washed with purified water and then subjected to ultrasonic cleaning in hydrogen peroxide. Any conventionally used surfactant may be employed for the purpose of the present invention.

The cleaned surface of the substrate is then contacted with a polar organic compound preferably having a molecular weight of not greater than 100. Examples of the polar organic compounds include alcohols such as methanol, ethanol, propanol, butanol, amyl alcohol; ketones such as acetone, methyl ethyl ketone and acetyl acetone; ethers such as dibutyl ether; aldehydes such as formaldehyde and acetaldehyde; organic acids such as formic acid, acetic acid, propionic acid, butyric acid, caprylic acid, oleic acid, succinic acid, citric acid, lactic acid, phenol and toluic acid; esters such as butyl butylate; amines such as dimethylamine and aniline; amides such as N-methylacetamide and formamide; dimethylsulfoxide; and heterocyclic compounds such as pyridine and furfral.

The contact of the cleaned surface of the substrate with the polar compound may be carried out by any suitable method such as by dipping the cleaned surface in a liquid polar solvent or by spraying the polar compound which may be a liquid or vapors over the cleaned surface of the substrate. The cleaned surface of the substrate on which the polar compound has been applied is generally dried at a temperature of 20–100° C. for 1–60 minutes. In this case, it is important that the drying operation should not be performed extensively and that the polar compound remains adsorbed on the cleaned surface of the substrate.

A hydrocarbon solvent solution of an organic group-containing metal compound is then applied on the polar organic compound-adsorbed surface of the substrate. The organic group-containing metal compound may be, for example, a metal salt of an organic acid, a metal salt of phenol and an organic chelate. Illustrative of suitable organic group-containing metal compounds are metal salts of naphthenic acid, 2-ethylhexanoic acid, caprylic acid, stearic acid, lauric acid, butyric acid, propionic acid, succinic acid, citric acid, lactic acid, salicylic acid or ethylenediaminetetracetic acid, metal phenolates and metal acetylacetonate. The metal of the organic group-containing metal compound may be, for example, Fe, Co, Ni, Ti, Cr or Mn. Two or more organic group-containing metal compounds may be used in combination, if desired.

The hydrocarbon solvent for the organic group-containing metal compound may be, for example, hexane, octane, benzene, toluene, tetralin or a mixture thereof. The concentration of the organic group-containing metal compound in the hydrocarbon solvent solution is generally 0.1–40% by weight.

The application of the hydrocarbon solvent solution of an organic group-containing metal compound on the polar compound-adsorbed surface of the substrate may be carried out by any known method such as by immersion, spraying, brush coating or spin coating. The liquid coating (liquid film) thus obtained is then dried to obtain a layer of the organic group-containing metal compound generally having a thickness of 0.01–1 μm, preferably 0.01–0.05 μm. The drying of the liquid film may be carried out at room temperature or an elevated temperature of, for example, up to 200° C. for 5–60 minutes.

The dried layer is then calcined at temperatures of generally up to 1,000° C. in air or an inert atmosphere. During the calcination, the organic group-containing metal compound is thermally decomposed to form a metal oxide which is then crystallized and grown into a dense, epitaxial metal oxide film.

The following examples will further illustrate the present invention.

EXAMPLE 1

An R surface ((012) surface) of a commercially available sapphire substrate (single crystal alumina substrate) was subjected to an ultrasonic cleaning in a surfactant (Extrane) for 10 minutes, followed by washing with purified water and by ultrasonic cleaning in an aqueous hydrogen peroxide for 10 minutes. The cleaned surface was then rinsed with methanol and dried for 10 minutes in air to form a methanol-deposited surface.

A commercially available mineral sprit solution of iron 2-ethylhexanoate (Fe content: 6% by weight) was diluted with 15 times the volume of toluene to obtain a coating liquid. The coating liquid was applied on the above methanol-deposited surface of the substrate by spin coating at 4,000 rpm for 10 seconds. The substrate having the thus formed liquid film was then heated in an oven to 150° C. at a heating rate of 10° C. per minute, maintained at that temperature for 15 minutes and then allowed to be cooled to room temperature, thereby to obtain a dried layer of iron 2-ethylhexanoate provided on the substrate. The substrate was then calcined at 500° C. for 1 hour in air to decompose and oxidize the iron 2-ethylhexanoate and then at 800° C. for 2 hour in air to form an epitaxial dense iron oxide (hematite) film. The atomic force microscopy revealed that the film consisted of rectangular particles densely regularly arranged and each having a size of about 0.1 μm.

EXAMPLE 2

Example 1 was repeated in the same manner as described except that the substrate rinsed with methanol was dried at 50° C. for 10 minutes. A dense epitaxial iron oxide film was obtained.

EXAMPLE 3

Example 1 was repeated in the same manner as described except that the substrate rinsed with methanol was dried at 100° C. for 10 minutes. A dense epitaxial iron oxide film was obtained.

Comparative Example 1

Example 1 was repeated in the same manner as described except that the substrate rinsed with methanol was dried at 200° C. for 10 minutes. Dispersed iron oxide particles were obtained.

Comparative Example 2

Example 1 was repeated in the same manner as described except that toluene was used in place of methanol. Dispersed round iron oxide particles were obtained.

Comparative Example 3

Example 1 was repeated in the same manner as described except that the ultrasonic cleaning steps in extrane and in the aqueous hydrogen peroxide solution were not carried out. Dispersed iron oxide particles were obtained.

EXAMPLE 4

Example 1 was repeated in the same manner as described except that ethanol was substituted for methanol. A dense epitaxial iron oxide film was obtained. However, the denseness of the film was inferior as compared with the product of Example 1.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A process for preparing a dense, epitaxial metal oxide film, comprising the steps of:

cleaning a surface of a single crystal substrate;

then contacting said cleaned surface with a polar organic compound so that said cleaned surface adsorbs said polar organic compound;

then applying a hydrocarbon solvent solution containing at least one organic group-containing metal compound on said polar organic compound-adsorbed surface; and then heating said substrate to decompose said organic group-containing metal compound and to form a dense epitaxial metal oxide film on said substrate.

2. A process as claimed in claim 1, wherein said cleaning is by ultrasonic cleaning in a cleaning liquid containing a surfactant followed by washing with purified water and ultrasonic cleaning in an aqueous hydrogen peroxide solution.

3. A process as claimed in claim 1, wherein said polar compound is methanol.

4. A process as claimed in claim 1, wherein said organic group-containing metal compound is selected from the group consisting of metal salts of organic acids, metal phenolates and metal organic chelates.

5. A composite material comprising a single crystal substrate and an epitaxially grown metal oxide film, and obtained by a process according to claim 1.

* * * * *